US008070254B2

(12) United States Patent
Heo et al.

(10) Patent No.: US 8,070,254 B2
(45) Date of Patent: Dec. 6, 2011

(54) PRINTING HEAD CLEANING APPARATUS, IMAGE FORMING APPARATUS HAVING THE SAME AND METHOD TO CLEAN PRINTING HEAD

(75) Inventors: Jung-dae Heo, Suwon-si (KR); Karp-sik Youn, Hwaseong-si (KR); Dong-woo Ha, Hwaseong-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 190 days.

(21) Appl. No.: 12/394,334

(22) Filed: Feb. 27, 2009

(65) Prior Publication Data

US 2009/0303280 A1 Dec. 10, 2009

(51) Int. Cl.
*B41J 2/165* (2006.01)

(52) U.S. Cl. ..... 347/28

(58) Field of Classification Search ..... 347/28, 347/32, 33, 42
See application file for complete search history.

(56) References Cited

U.S. PATENT DOCUMENTS

| | | | | |
|---|---|---|---|---|
| 5,574,485 | A * | 11/1996 | Anderson et al. | 347/27 |
| 5,600,354 | A * | 2/1997 | Hackleman et al. | 347/50 |
| 6,623,106 | B2 * | 9/2003 | Silverbrook | 347/49 |
| 7,278,700 | B2 * | 10/2007 | Yamaguchi et al. | 347/13 |
| 7,510,265 | B2 * | 3/2009 | Kang et al. | 347/33 |

* cited by examiner

*Primary Examiner* — Kristal Feggins
(74) *Attorney, Agent, or Firm* — Stanzion & Kim, LLP

(57) ABSTRACT

A printing head cleaning apparatus usable with an image forming apparatus includes a spraying unit to spray a quantity of cleaning solution using a sprayer and a cleaning shuttle to carry the spraying unit. The spraying unit includes a cleaning solution tank to store the cleaning solution sprayed by the sprayer, a spraying cam to operate the sprayer to selectively spray a quantity of the cleaning solution, and a cam driving member to cause the spraying cam to rotate according to movement of the cleaning shuttle.

19 Claims, 5 Drawing Sheets

PRINTING HEAD CLEANING APPARATUS, IMAGE FORMING APPARATUS HAVING THE SAME AND METHOD TO CLEAN PRINTING HEAD

CROSS-REFERENCE TO RELATED APPLICATIONS

This application claims priority under 35 U.S.C. §119(a) from Korean Patent Application No. 2008-52742 filed Jun. 4, 2008 in the Korean Intellectual Property Office, the disclosure of which is incorporated herein by reference in its entirety.

BACKGROUND OF THE INVENTION

1. Field of the Invention

The present general inventive concept relates to an image forming apparatus. More particularly, the present general inventive concept relates to a printing head cleaning apparatus usable with an image forming apparatus having a plurality of printing heads that are disposed in a direction transverse to a travel direction of a printing medium, the image forming apparatus having the same, and a method to clean the printing heads.

2. Description of the Related Art

Image forming apparatuses, especially inkjet image forming apparatuses, using ink to form images, may include a shuttle head type, having a carrier formed to reciprocate a printing head to fire ink, and an array head type, having a plurality of printing heads arranged to correspond to a size of a printing medium in a direction transverse to a transferring direction of the printing medium. A printing head usable with the array head type inkjet image forming apparatus may be formed in approximately half or more of the size of the printing medium in a direction transverse to a transferring direction of the printing medium. Two or more printing heads may be arranged in one row or in two rows. The array head type inkjet image forming apparatus may be configured so that the printing heads are stationary and the printing media are moved.

The shuttle head type inkjet image forming apparatus is cheap, has a simple structure but is slow to print. The array head type inkjet image forming apparatus is expensive and has a complex structure compared with the shuttle head type inkjet image forming apparatus, but can print at high speed and/or in high resolution.

However, in inkjet image forming apparatuses having nozzles to fire ink regardless of the shuttle head type and the array head type, ink that has not been moved to the printing medium during a printing operation may remain on the nozzle of the inkjet head after the printing operation. Therefore, if the inkjet image forming apparatus has not been used for a long time, the remaining ink may be solidified and clog the nozzle so that the printing operation cannot be performed normally. In other words, when the inkjet image forming apparatus has not been used for a period of time, the remaining ink may react with outside air so as to be solidified on the nozzle of the printing head. Also, the remaining ink may be solidified with contaminants, such as dust entering from the outside, to clog the nozzle. A phenomenon in that the nozzle is clogged with the solidified ink and/or contaminants is referred to as 'nozzle clog'. The nozzle clog deteriorates printing quality.

When the nozzle clog occurs, ink is solidified on a nozzle surface of the printing head. Therefore, even when the nozzle surface is cleaned using a dry wiping apparatus, such as a cleaning wiper unit formed to contact and clean the nozzle surface of the printing head before or after the printing operation, it is difficult to remove the solidified ink from the nozzle surface.

To solve this problem, it has been required to develop a printing head cleaning apparatus that can dissolve and remove the solidified ink from the nozzle surface of the printing head.

SUMMARY OF THE INVENTION

The present general inventive concept provides a printing head cleaning apparatus to spray a quantity of cleaning solution to a printing head so as to easily remove solidified ink from a nozzle surface of the printing head, an image forming apparatus having the same, and a method to clean the printing head.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept can be achieved by providing a printing head cleaning apparatus usable with an image forming apparatus, which includes a spraying unit to spray a quantity of cleaning solution using a sprayer, and a cleaning shuttle to carry the spraying unit.

The spraying unit may include a cleaning solution tank to store the cleaning solution sprayed by the sprayer, a spraying cam to operate the sprayer to selectively spray a quantity of the cleaning solution, and a cam driving member to cause the spraying cam to rotate according to movement of the cleaning shuttle.

The spraying unit may include a spraying direction changing member to change a spraying direction of the sprayer.

The cam driving member may include a rack gear disposed parallel to a moving direction of the cleaning shuttle, a driven gear to engage with the rack gear, the driven gear rotatably disposed at the cleaning shuttle, and a cam gear train to transmit rotation of the driven gear to the spraying cam, wherein when the cleaning shuttle moves, the driven gear and the cam gear train cause the spraying cam to rotate.

When the spraying cam rotates at or above reference speed, the sprayer may spray the cleaning solution. When the spraying cam rotates below the reference speed, the sprayer may not spray the cleaning solution.

The printing head cleaning apparatus may include a shuttle driving member to cause the cleaning shuttle to move.

The shuttle driving member may include a belt to which the cleaning shuttle is fixed, driving and driven pulleys to support the belt to move along a caterpillar track, and a driving motor to rotate the driving pulley.

The shuttle driving member may include a guide rail to guide the movement of the cleaning shuttle.

Embodiments of the present general inventive concept can also be achieved by providing an image forming apparatus that may include an ink cartridge having at least one printing head to fire ink onto a printing medium, a spraying unit spaced apart from the at least one printing head of the ink cartridge, the spraying unit formed to spray a quantity of cleaning solution toward the at least one printing head using a sprayer, a cleaning shuttle in which the spraying unit is disposed, a shuttle driving member to cause the cleaning shuttle to move in a direction transverse to a transferring direction of the printing medium, and a control portion to control the shuttle driving member so that the spraying unit sprays a quantity of cleaning solution.

The shuttle driving member may include a belt to which the cleaning shuttle is fixed, driving and driven pulleys to support the belt to move along a caterpillar track, and a driving motor to rotate the driving pulley.

The shuttle driving member may include a guide rail disposed parallel to the belt to guide movement of the cleaning shuttle.

The spraying unit may include a cleaning solution tank to store the cleaning solution sprayed by the sprayer, a spraying cam to operate the sprayer to selectively spray the cleaning solution, and a cam driving member to cause the spraying cam to rotate according to the movement of the cleaning shuttle.

The cam driving member may include a rack gear disposed on a top surface of the guide rail, a driven gear to engage with the rack gear, the driven gear rotatably disposed at the cleaning shuttle, and a cam gear train to transmit rotation of the driven gear to the spraying cam, wherein when the shuttle driving member causes the cleaning shuttle to move, the rack gear causes the driven gear to rotate so that the spraying cam rotates.

The control portion may control the shuttle driving member so that the spraying unit sprays the cleaning solution directly to the at least one printing head.

The control portion may control the shuttle driving member so that the spraying unit sprays the cleaning solution to an area between each of the at least one printing head.

The control portion may control the spraying unit so that when the cleaning shuttle moves in a first direction, the spraying unit sprays a quantity of cleaning solution, and when the cleaning shuttle moves in a second direction, the spraying unit does not spray a quantity of cleaning solution.

The control portion may control moving speed of the cleaning shuttle so that the sprayer selectively sprays a quantity of cleaning solution.

Embodiments of the present general inventive concept can also be achieved by providing an image forming apparatus that may include: an ink cartridge having a plurality of printing heads to fire ink onto a printing medium, the plurality of printing heads arranged in a plurality of rows in a transferring direction of the printing medium, a spraying unit spaced apart from the plurality of printing heads of the ink cartridge, the spraying unit formed to spray a quantity of cleaning solution to the plurality of printing heads using at least one sprayer, a cleaning shuttle in which the spraying unit is disposed, a shuttle driving member to cause the cleaning shuttle to move in a direction transverse to the transferring direction of the printing medium, and a control portion to control the shuttle driving member so that the spraying unit sprays a quantity of cleaning solution.

The spraying unit may be formed so that the number of the at least one sprayer is the same as the number of rows of the plurality of printing heads, and the at least one sprayer is disposed to corresponding to each of the rows of the plurality of printing heads.

The spraying unit may be formed so that the at least one sprayer is formed to change a spraying direction so as to spray the cleaning solution corresponding to each of rows of the plurality of printing heads.

The spraying unit may be formed so that the number of the at least one sprayer is smaller than the number of rows of the plurality of printing heads, and the at least one sprayer is disposed corresponding to at least one area between the rows of the plurality of printing heads.

Embodiments of the present general inventive concept can also be achieved by providing a method to clean at least one printing head of an ink cartridge, the method may include moving a cleaning shuttle from a home position to a position below the at least one printing head, causing a sprayer of the cleaning shuttle to spray toward the at least one printing head, and returning the cleaning shuttle to the home position.

The method to clean at least one printing head of an ink cartridge may include after the cleaning shuttle returns to the home position, causing a wiping unit to wipe the at least printing head.

When the cleaning shuttle moves at or above reference speed, the sprayer sprays the cleaning solution, and when the cleaning shuttle moves below reference speed, the sprayer does not spray the cleaning solution.

Embodiments of the present general inventive concept can also be achieved by providing a printing head cleaning apparatus usable with an image forming apparatus having a print head, including: a spray unit disposed to move with respect to the print head and to spray a cleaning solution toward the print head while moving with respect to the print head.

The spray unit may include a body, and a sprayer mounted on the body to rotate with respect to the body to spray the cleaning solution toward the print head.

The print head may include a first nozzle and a second nozzle, where the spray unit sprays a first amount of cleaning solution towards the first nozzle and a second amount of the cleaning solution toward the second nozzle.

An amount of the cleaning solution may vary while moving with respect to the print head.

The spray unit may spray the cleaning solution in a spray direction which is variable while moving with respect to the print head.

Embodiments of the present general inventive concept can also be achieved by providing an image forming apparatus, including: an ink cartridge with at least one print head, and a spray unit disposed to move with respect to the at least one print head and to spray a cleaning solution toward the at least one print head while moving with respect to the at least one print head

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION

Figure 1:
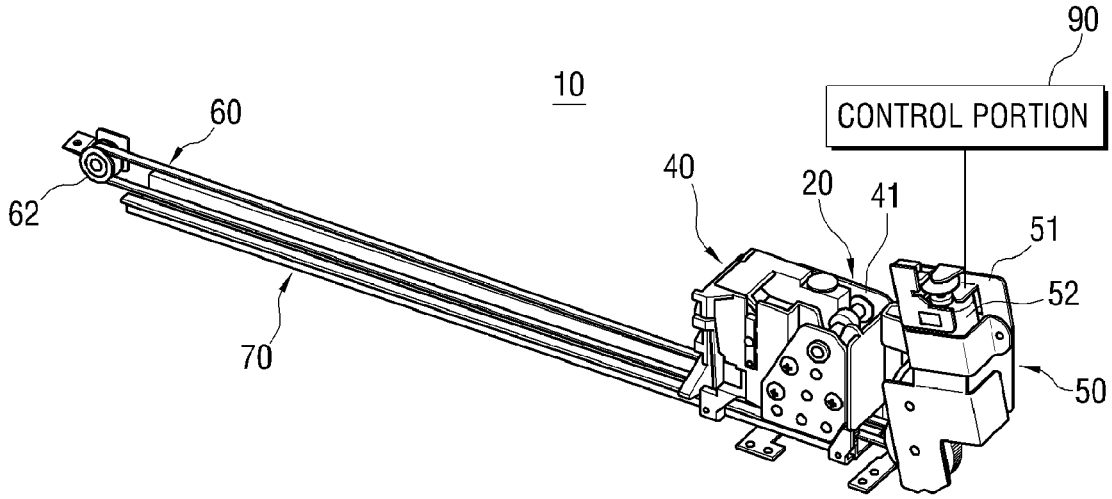
FIG. 1 is a perspective view to illustrate a printing head cleaning apparatus usable with an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

The matters defined in the description, such as a detailed construction and elements thereof, are provided to assist in a comprehensive understanding of the present general inventive concept. Thus, it is apparent that the present general inventive concept may be carried out without those defined matters. Also, well-known functions or constructions are omitted to provide a clear and concise description of exemplary embodiments of the present invention.

Figure 2:
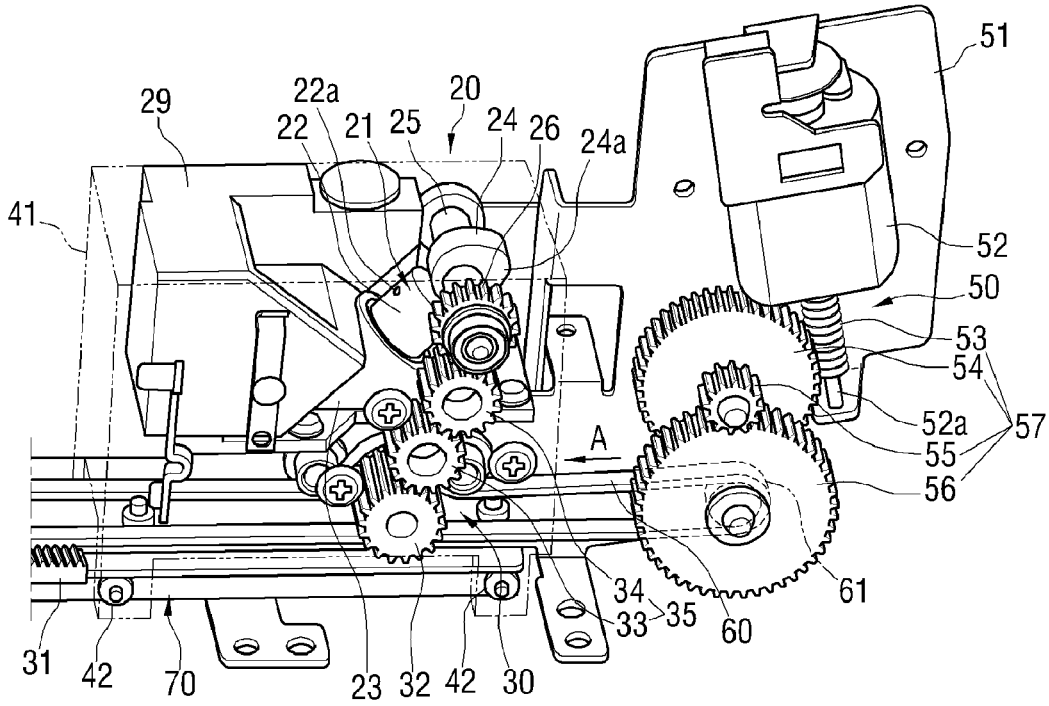
FIG. 2 is a partial perspective view to illustrate the printing head cleaning apparatus of FIG. 1 to show a structure of a spraying unit disposed at a cleaning shuttle.
Figure 3:
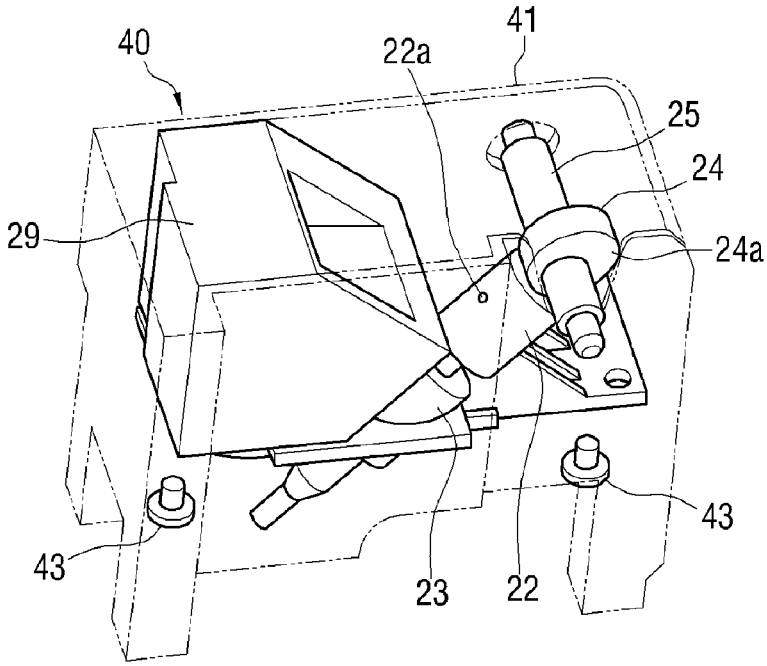
FIG. 3 is a perspective view to illustrate a sprayer and a spraying cam of the spraying unit disposed at the cleaning shuttle of FIG. 2.

FIG. 1 is a perspective view to illustrate a printing head cleaning apparatus 10 usable with an image forming apparatus according to an embodiment of the present general inventive concept. FIG. 2 is a partial perspective view to illustrate the printing head cleaning apparatus 10 of FIG. 1 to show a structure of a spraying unit 20 disposed at a cleaning shuttle 40. In FIG. 2, a housing 41 of the cleaning shuttle 40 is presented by an alternative long and two short dashes line. FIG. 3 is a perspective view to illustrate a sprayer 21 and a spraying cam 24 of the spraying unit 20 disposed at the cleaning shuttle 40 of FIG. 2.

Referring to FIGS. 1 to 3, the printing head cleaning apparatus 10 usable with an image forming apparatus according to an embodiment of the present general inventive concept may include the spraying unit 20, the cleaning shuttle 40, a shuttle driving member 50, and a control portion 90.

The spraying unit 20 includes the sprayer 21 to spray a quantity of cleaning solution, a cleaning solution tank 29 to store the cleaning solution, the spraying cam 24 to operate the sprayer 21, and a cam driving member 30 to cause the spraying cam 24 to rotate.

Figure 4:
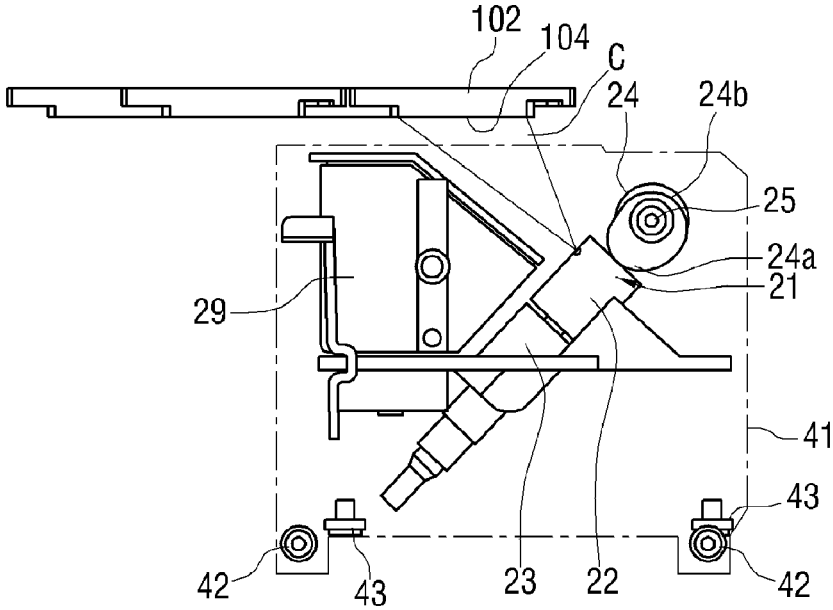
FIG. 4 is a side view to illustrate a printing head cleaning apparatus usable with an image forming apparatus to spray a quantity of cleaning solution to a printing head according to an embodiment of the present general inventive concept.

The sprayer 21 may include a body portion 23 and a head 22 disposed to slide up and down with respect to the body portion 23. The head 22 of the sprayer 21 is provided with a spraying hole 22*a* through which a quantity of cleaning solution is sprayed. The body portion 23 of the sprayer 21 is in fluid communication with the cleaning solution tank 29. Therefore, when the head 22 is pushed down, the cleaning solution of the cleaning solution tank 29 is sprayed from the spraying hole 22*a* via the body portion 23 and head 22 of the sprayer 21. The sprayer 21 may be formed so that when the head 22 is pushed at high speed, that is, at or above reference speed, the sprayer 21 can spray a quantity of cleaning solution C as illustrated in FIG. 4, and when the head 22 is pushed at low speed, that is, below reference speed, the sprayer 21 does not spray the quantity of cleaning solution C. Detailed structure and operation of a sprayer to spray a quantity of cleaning solution may be similar to those of general sprayers, such as a hair sprayer, an insecticidal sprayer, etc. Therefore, a detail description thereof will be omitted.

As used herein, the term "reference speed" refers to a minimum speed at which the head 22 is pushed down in order for the sprayer to spray a quantity of cleaning solution. For example, if the head 22 is pushed down at a speed less than the reference speed, the sprayer does not spray cleaning solution. If the head 22 is pushed down at a speed equal to or greater than the reference speed, the spray does spray the cleaning solution.

Also, the sprayer 21 may be configured to change a spraying direction of cleaning solution. In other words, the head 22 of the sprayer 21 may be formed to rotate with respect to the body portion 23 of the sprayer 21, and a spraying direction changing member (not illustrated) may be formed to rotate the head 22 so as to change an orientation of the spraying hole 22*a* of the head 22. At this time, although not illustrated, the spraying direction changing member may be formed to receive power from the cam driving member 30.

The cleaning solution tank 29 may be disposed at a side of the sprayer 21 and store a predetermined quantity of cleaning solution. Various kinds of liquid can be used as the cleaning solution as long as the liquid can dissolve ink solidified on a nozzle surface 104 (see FIG. 7) of the printing head 102 (see FIG. 7) to clog the nozzle 103 (see FIG. 7) and does not damage the printing head 102.

The spraying cam 24 operates the sprayer 21 to selectively spray a quantity of cleaning solution, and may be disposed to rotate integrally with a camshaft 25. Opposite end portions of the camshaft 25, as illustrated in FIG. 3, are rotatably supported by the housing 41 of the cleaning shuttle 40. The spraying cam 24 has a high portion 24*a* and a low portion 24*b*. When the high portion 24*a* of the spraying cam 24 contacts the head 22 of the sprayer 21, the head 22 is pushed down to move toward the body portion 23. When the low portion 24*b* of the spraying cam 24 contacts the head 22 of the sprayer 21, the head 22 is not pushed down. By a side of the camshaft 25 may be disposed a cam gear 26 to receive power from the cam driving member 30.

The cam driving member 30 may be formed to rotate the spraying cam 24 according to movement of the cleaning shuttle 40. The cam driving member 30 may include a rack gear 31, a driven gear 32, and a cam gear train 35.

The rack gear 31 may be disposed parallel to a moving direction of the cleaning shuttle 40. In other words, the rack gear 31 may be disposed in a direction transverse to a transferring direction of a printing medium. In this embodiment, the rack gear 31 is disposed on a top surface of a guide rail 70 of the shuttle driving member 50. The rack gear 31 may be formed integrally with the guide rail 70. Alternatively, the rack gear 31 may be formed in a separate part, and disposed on the top surface of the guide rail 70.

The driven gear 32 may be disposed at the housing 41 of the cleaning shuttle 40 to engage with the rack gear 31 and to rotate. Therefore, when the cleaning shuttle 40 moves, the driven gear 32 to engage with the rack gear 31 rotates.

The cam gear train 35 connects the driven gear 32 with the cam gear 26 so as to transmit rotation of the driven gear 32 to the spraying cam 24. Therefore, when the driven gear 32 is rotated by the movement of the cleaning shuttle 40, the cam gear 26 rotates. In this embodiment, the cam gear train 35 includes a first idle gear 33 to engage with the driven gear 32 and a second idle gear 34 to engage with the cam gear 26. However, this does not limit the structure of the cam gear train 35. According to conditions of the spraying cam 24, such as an installing location, a rotation speed, a rotating direction thereof, etc., the cam gear train 35 may be formed to include one gear, three gears or more.

The cleaning shuttle 40 carries the spraying unit 20 to a predetermined position so that the spraying unit 20 sprays a quantity of cleaning solution toward the printing head 102. The cleaning shuttle 40 may include the housing 41 in which the cleaning solution tank 29, the sprayer 21, and the cam driving member 30 of the spraying unit 20 are disposed, and four wheels 42 disposed on a lower portion of the housing 41. The cleaning solution tank 29 may be detachably disposed in the housing 41 of the cleaning shuttle 40 so that when the cleaning solution stored in the cleaning solution tank 29 is depleted, additional cleaning solution can be refilled to the cleaning solution tank 29 or the empty cleaning solution tank 29 can be replaced with a new cleaning solution tank.

The four wheels 42 allow the cleaning shuttle 40 to smoothly move along the guide rail 70. Also, as illustrated in FIGS. 3 and 4, the cleaning shuttle 40 may further include a pair of guide rollers 43 disposed on a bottom surface of the housing 41. The pair of guide rollers 43 may be disposed to move along a middle wall of the guide rail 70 so that the cleaning shuttle 40 can stably move along the guide rail 70. Roller bearings can be used as the four wheels 42 and/or the pair of guide rollers 43.

The shuttle driving member 50 is configured to linearly reciprocate the cleaning shuttle 40 in a direction transverse to a transferring direction of the printing medium. The shuttle driving member 50 may include a belt 60, driving and driven pulleys 61 and 62 to support and rotate the belt 60 to move along a caterpillar track, and a driving motor 52 to rotate the driving pulley 61.

The cleaning shuttle 40 is fixed to the belt 60. Therefore, when the belt 60 is rotated by the driving and driven pulleys 61 and 62, the cleaning shuttle 40 moves together with the belt 60. A timing belt may be used as the belt 60.

The driving pulley 61 receives power from the driving motor 52, and then, rotates. The driving pulley 61 may be coupled directly with a motor shaft 52*a* of the driving motor 52. However, in this embodiment, a driving gear train 57 is disposed between the driving pulley 61 and the driving motor 52. The driving gear train 57 may include a worm gear 53 disposed on the motor shaft 52*a* of the driving motor 52, a wheel gear 54 to engage with the worm gear 53, a pinion gear 55 that is disposed coaxially with the wheel gear 54 and rotates integrally with the wheel gear 54, and a pulley gear 56 that is disposed coaxially with the driving pulley 61 and rotates integrally with the driving pulley 61. Therefore, when the driving motor 52 operates to rotate the worm gear 53 disposed on the motor shaft 52*a*, the wheel gear 54 to engage with the worm gear 53 rotates. When the wheel gear 54 rotates, the pinion gear 55 disposed coaxially with the wheel gear 54 rotates integrally with the wheel gear 54. When the pinion gear 55 rotates, the pulley gear 56 to engage with the pinion gear 55 rotates. When the pulley gear 56 rotates, the driving pulley 61 disposed coaxially with the pulley gear 56 rotates. When the driving pulley 61 rotates, the belt 60 supported by the driving and driven pulleys 61 and 62 moves.

The guide rail 70 guides the cleaning shuttle 40 to stably move in a straight line. The guide rail 70 is formed to guide the four wheels 42 of the cleaning shuttle 40. The middle wall of the guide rail 70 contacts the pair of guide rollers 43 and supports the movement of the pair of guide rollers 43. Therefore, the guide rail 70, the pair of guide rollers 43, and the four wheels 42 allow the cleaning shuttle 40 to reciprocate linearly in a direction transverse to a transferring direction of the printing medium. Also, as illustrated in FIG. 5, on the top surface of the guide rail 70 may be disposed the rack gear 31 to engage with the driven gear 32 of the spraying unit 20.

Figure 6:
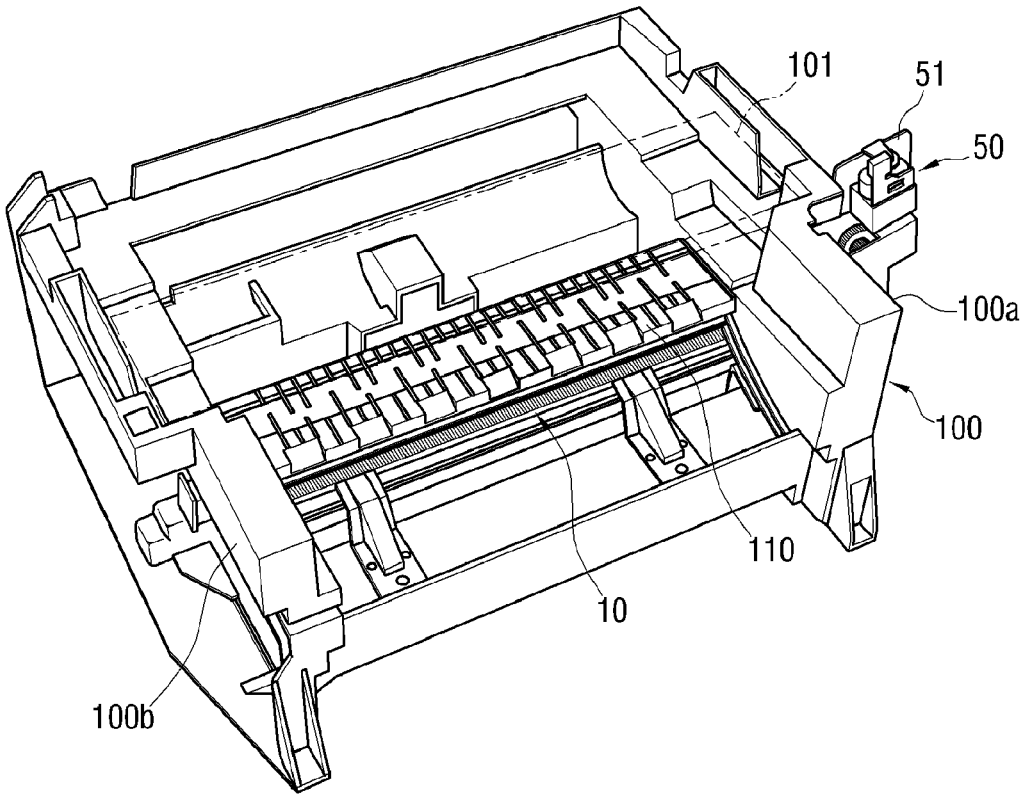
FIG. 6 is a perspective view to illustrate a mainframe of an image forming apparatus in which a printing head cleaning apparatus usable with an image forming apparatus and a maintenance unit are disposed according to an embodiment of the present general inventive concept.

A motor bracket 51 may be disposed at an end of the guide rail 70. The wheel gear 54 and the driving pulley 61 are rotatably disposed on the motor bracket 51. The driving motor 52 is disposed at a side of the wheel gear 54. When the printing head cleaning apparatus 10 is disposed on the mainframe 100, the motor bracket 51, as illustrated in FIG. 6, projects outside from a sidewall 100*a* of the mainframe 100. A space in which the cleaning shuttle 40 stays may be formed between the motor bracket 51 and the sidewall 100*a* of the mainframe 100. The space is a home position in which the cleaning shuttle 40 of the printing head cleaning apparatus 10 standbys before or after a printing operation.

The control portion 90 controls the driving motor 52 of the shuttle driving member 50 so that the sprayer 21 of the spraying unit 20 sprays a quantity of cleaning solution. The control portion 90 may be configured integrally with a main control portion (not illustrated) to control the image forming apparatus to form images. The control portion 90 controls rotation speed and rotating direction of the driving motor 52 so that the spraying unit 20 cleans the plurality of printing heads 102 of the ink cartridge 101.

Figure 5:
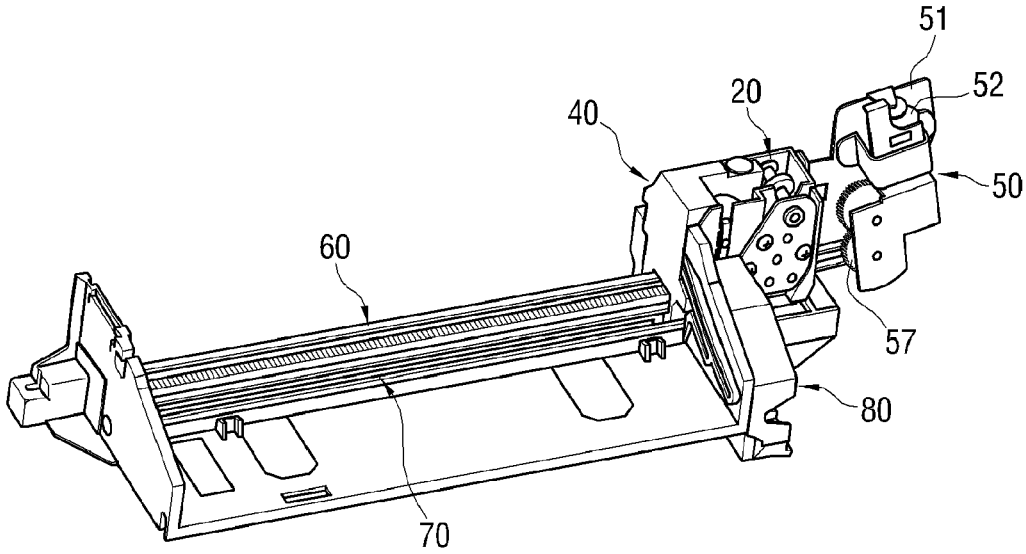
FIG. 5 is a perspective view to illustrate a printing head cleaning apparatus usable with an image forming apparatus disposed on a maintenance frame according to an embodiment of the present general inventive concept.

The printing head cleaning apparatus 10 according to an embodiment of the present general inventive concept, as illustrated in FIG. 5, may be disposed on a maintenance frame 80. The maintenance frame 80 may support the driven pulley 62 in such a manner as to allow the driven pulley 62 to rotate. On the maintenance frame 80 may be disposed a wiping unit 110 (see FIG. 6) that physically contacts and wipes the nozzle surface 104 of the printing head 102. Also, a spitting chamber (not illustrated) to receive spitting ink of the nozzle 103 of the printing head 102 may be disposed at a side of the wiping unit 110. Structures of the wiping unit 110 and the spitting chamber are the same as or similar to those of the conventional array head type image forming apparatus; therefore, descriptions thereof are not repeated.

Furthermore, although not illustrated, the wiping unit 110 may be disposed in the cleaning shuttle 40 of the printing head cleaning apparatus 10 together with the spraying unit 20. Then, when the cleaning shuttle 40 moves, the wiping unit 110 disposed in the cleaning shuttle 40 may clean the nozzle surface 104 of the printing head 102.

The maintenance frame 80, as illustrated in FIG. 6, may be fixed to the mainframe 100 of the image forming apparatus. At the mainframe 100 may be disposed the ink cartridge 101 having a plurality of nozzles 103 to fire ink onto the printing medium, a printing medium loading unit (not illustrated) to store a predetermined sheets of printing media, and a printing medium feeding unit that picks up the printing media loaded in the printing medium loading unit one by one and feeds the printing medium beneath the printing head 102.

At the mainframe 100 may be disposed a platen (not illustrated) that supports the printing medium fed by the printing medium feeding unit to position near the printing head 102 of the ink cartridge 101. During printing operation the platen is located under the printing head 102 of the ink cartridge 101. However, when cleaning the printing head 102, the platen moves to form a space through which the cleaning shuttle 40 moves so that the sprayer 21 of the printing head cleaning apparatus 10 can spray a quantity of cleaning solution toward the printing head 102.

Figure 7:
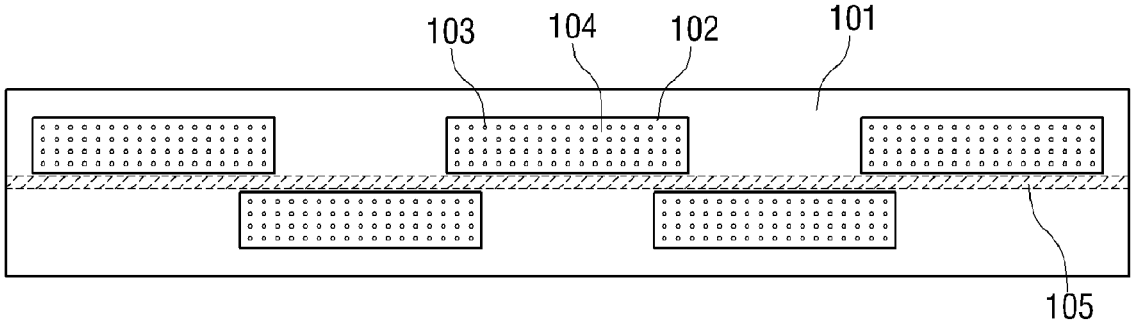
FIG. 7 is a bottom view to illustrate an ink cartridge usable with an image forming apparatus having a plurality of printing heads arranged in two rows.

The ink cartridge 101 stores a predetermined quantity of ink, and has at least one printing head 102 disposed on the bottom surface thereof. The ink cartridge 101 may have a plurality of printing heads 102 disposed to correspond to a size of a printing medium in a direction transverse to a transferring direction of the printing medium. FIG. 7 illustrates the plurality of printing heads 102 disposed on the bottom surface of the ink cartridge 101. A printing head 102 is provided with a plurality of nozzles 103 to fire or spray ink.

Figure 8:
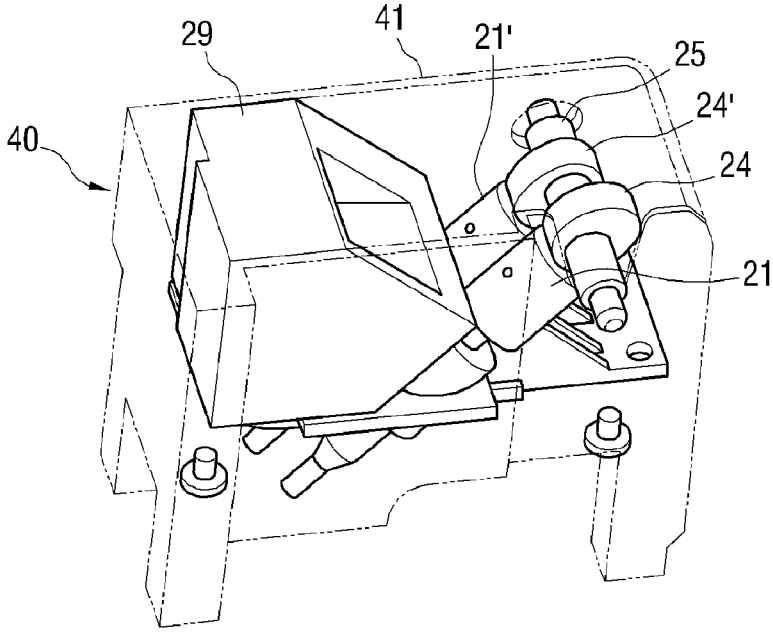
FIG. 8 is a perspective view to illustrate a cleaning shuttle having two sprayers corresponding to the two rows of printing heads of the ink cartridge of FIG. 7.

When the plurality of printing heads 102 is arranged in two rows in the transferring direction of the printing medium as illustrated in FIG. 7, the spraying unit 20 may have two sprayers 21 and 21' corresponding to the two rows of the printing heads 102 as illustrated in FIG. 8. At this time, each of the sprayers 21 and 21' is formed to spray a quantity of cleaning solution toward the printing heads 102 of the row corresponding to each of the sprayers 21 and 21'. If the plurality of printing heads 102 is arranged in three rows or more in the transferring direction of the printing medium, three sprayers 21 or more may be disposed to correspond to the number of the rows of the printing heads 102.

Alternatively, when the plurality of printing heads 102 is arranged in two rows or more in the transferring direction of the printing medium, the spraying unit 20 may be formed to have one sprayer 21 and the spraying direction changing member (not illustrated). The spraying direction changing member may rotate the head 22 of the sprayer 21 by a predetermined angle to change the orientation of the spraying hole 22*a*, thereby changing of the direction in which the cleaning solution is sprayed. Therefore, the one sprayer 21 can spray a quantity of cleaning solution toward each of the plurality of printing heads 102 forming the two or more rows.

Alternatively, when the plurality of printing heads 102 is arranged in two rows or more in the transferring direction of the printing medium, the spraying unit 20 may be formed to have the number of the sprayer 21 corresponding to the number of areas 105 among a plurality of printing head rows (for example, a hatching area 105 in FIG. 7). For example, as illustrated in FIG. 7, when the plurality of printing heads 102 is arranged in two rows in the transferring direction of the printing medium, there is one area 105 between the printing head rows 102. So one sprayer 21 is disposed at the spraying unit 20. If the sprayer 21 is disposed to correspond to the area 105 between the printing head rows 102, the sprayer 21 sprays the cleaning solution not directly to the printing head 102 but to the area 105 between the printing head rows 102. So the cleaning solution as mist sprayed to the area 105 between the printing head rows 102 moves toward the opposite printing heads 102 to dissolve ink solidified on the nozzle surface 104 and/or the nozzles 103 of the printing head 102. If the printing head 102 is apt to receive impact by the cleaning solution sprayed by the sprayer 21, the indirect spraying of the cleaning solution can reduce the impact.

Hereinafter, operation of the image forming apparatus having the printing head cleaning apparatus 10 according to an embodiment of the present general inventive concept having the above-described structure will be explained in detail.

During standby the cleaning shuttle 40 of the printing head cleaning apparatus 10 is located in the home position formed outside the sidewall 100*a* of the mainframe 100. Also, the plurality of printing heads 102 of the ink cartridge 101 are covered tightly by a capping module (not illustrated) so that the nozzles 103 are protected in an airtight state. When a printing operation starts, the capping module, having covered up the printing heads 102, moves so as to expose the nozzles 103 of the printing heads 102.

When the printing operation starts, the main control portion may perform a print ready process. In other words, the main control portion causes the capping module to move, thereby exposing the nozzles 103 of the printing heads 102. After the nozzles 103 are exposed, the control portion 90 performs a predetermined spitting process so that the nozzles 103 spit a quantity of ink and the wiping unit 110 wipes the nozzle surface 104 of the printing head 102 so as to remove the spitted ink. After the print ready process finishes, the platen (not illustrated) moves to a position adjacent to and below the nozzle 103 so as to face the nozzles 103.

Then, the main control portion controls the printing medium feeding unit to transfer the printing medium to a space between the nozzles 103 and the platen. The nozzles 103 of the printing heads 102 fire ink onto the transferred printing medium so as to form predetermined images thereon.

After the printing operation finishes, the platen may move to be separated from the nozzles 103 of the printing heads 102 and to form a space below the printing heads 102. Then the wiping unit 110 moves to the space below the printing heads 102 and wipes the nozzles 103 of the printing heads 102. After the wiping unit 110 finishes the wiping of the nozzles 103 and moves from the space below the printing heads 102, the capping module moves to cover up the printing heads 102, thereby preventing the nozzles 103 from being exposed to air.

A nozzle clog may occur in the printing heads 102 of the ink cartridge 101. The nozzle clog may occur when ink remaining on the nozzles 103 of the printing heads 102 of the ink cartridge 101 reacts with air. The ink remaining on the nozzles 103 may be solidified or contaminants are solidified along with the ink so as to clog the nozzle 103. When the nozzle clog occurs, the main control portion uses the printing head cleaning apparatus 10 to perform a printing head cleaning process to dissolve the ink solidified on the nozzles 103 of the printing heads 102.

When a detecting sensor (not illustrated) detects a nozzle clog, the printing head cleaning process may be started. Alternatively, a user may initiate the printing head cleaning process. Alternatively, the main control portion of the image forming apparatus may automatically start the printing head cleaning process according to a specific standard, such as the number of pages that have been printed, a predetermined time that has passed, etc.

In the printing head cleaning process, the main control portion causes the capping module that caps the printing heads 102 of the ink cartridge 101 or the platen adjacent to the printing heads 102 for printing to move, thereby forming a space in which the cleaning shuttle 40 can move below the printing heads 102.

After the space is formed below the printing heads 102, the control portion 90 controls the driving motor 52 so that the cleaning shuttle 40 moves from the home position to the space below the printing heads 102. In other words, when the motor shaft 52*a* of the driving motor 52 rotates, the driving pulley 61 is rotated by the driving gear train 57. When the driving pulley 61 rotates, the belt 60 connected with the driving pulley 61 moves in a direction of arrow A of FIG. 2. When the belt 60 moves in the direction of arrow A, the cleaning shuttle 40 fixed to the belt 60 moves to the inside of the mainframe 100, that is, the space below the printing heads 102 of the ink cartridge 101. When the cleaning shuttle 40 is located below the printing heads 102, the sprayer 21 is spaced apart from the printing heads 102 as illustrated in FIG. 4.

When the cleaning shuttle 40 moves inside the mainframe 100, the driven gear 32 of the cam driving member 30 is engaged with the rack gear 31 disposed on the top surface of the guide rail 70. While the cleaning shuttle 40 is being moved by the belt 60, the rack gear 31 allows the driven gear 32 to rotate. When the driven gear 32 rotates, the cam gear 26 is rotated by the first and second idle gears 33 and 34 to engage with the driven gear 32. When the cam gear 26 rotates, the spraying cam 24, which is coaxially disposed to the camshaft 25 with the cam gear 26, rotates. The spraying cam 24 rotates to push down the head 22 of the sprayer 21.

Rotation speed and cam shape of the spraying cam 24 may be used to control whether the sprayer 21 sprays a quantity of cleaning solution or not. In this embodiment, when the spraying cam 24 rotates at high speed, that is, at or above reference speed and the high portion 24*a* of the spraying cam 24 presses the head 22 of the sprayer 21, as illustrated in FIG. 4, the sprayer 21 sprays a quantity of cleaning solution. However, when the spraying cam 24 rotates at high speed and the lower portion 24*b* of the spraying cam 24 approaches or contacts the head 22, the sprayer 21 does not spray the cleaning solution.

When the control portion 90 controls the driving motor 52 to rotate at high speed, the cleaning shuttle 40 moves at high speed so that the spraying cam 24 rotates at high speed. Therefore, only when the high portion 24*a* of the spraying cam 24 pushes down the head 22 of the sprayer 21, the cleaning solution is sprayed. After the high portion 24*a* of the spraying cam 24 escapes from the head 22, the spraying of the cleaning solution is stopped. As a result, the printing head cleaning apparatus 10 according to an embodiment of the present general inventive concept can intermittently spray a quantity of cleaning solution corresponding to the plurality of printing heads 102 to be spaced apart from each other.

When the cleaning shuttle 40 reaches the opposite sidewall 100*b* of the mainframe 100, the control portion 90 controls the driving motor 52 to rotate in a reverse direction, thereby causing the cleaning shuttle 40 to return to the home position. At this time, the control portion 90 decreases the rotation speed of the driving motor 52 so that the spraying cam 24 rotates below the reference speed. As a result, even when the high portion 24*a* of the spraying cam 24 contacts or presses the head 22 of the sprayer 21, the cleaning solution is not sprayed. After the cleaning shuttle 40 returns to the home position, the main control portion controls the wiping unit 110 to wipe the nozzle surface 103 of the printing heads 102. At this time, the ink and/or contaminants solidified on the nozzle surface 104 of the printing heads 102 are dissolved and softened by the cleaning solution, and are easily removed from the printing heads 102 by wiping of the wiping unit 110.

After the wiping operation finishes, the main control portion causes the capping module to cover the printing heads 102, thereby preventing the nozzles 103 from contacting air.

Figure 9:
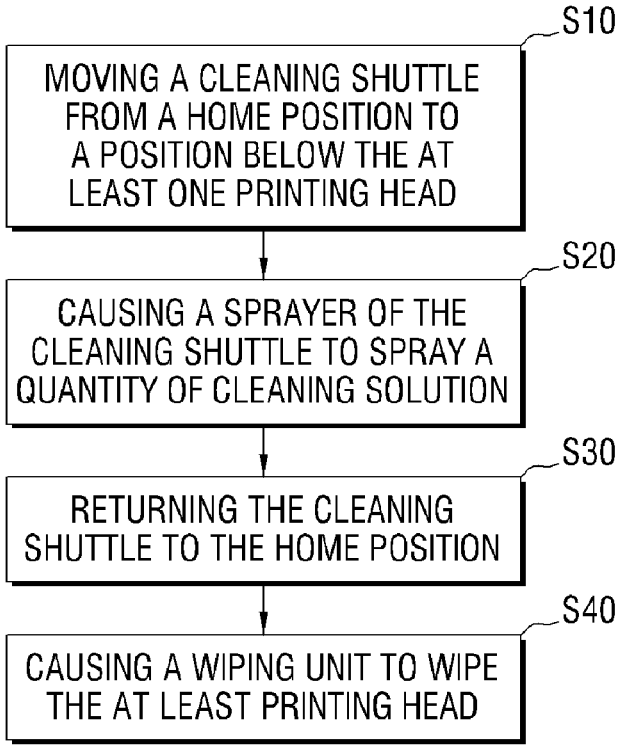
FIG. 9 is a flow chart to illustrate a method to clean a printing head according to an embodiment of the present general inventive concept.

Hereinafter, a method to clean the printing heads according to an embodiment of the present general inventive concept usable with an inkjet image forming apparatus having the printing head cleaning apparatus 10 will be explained with reference to FIG. 9.

In the image forming apparatus having at least one printing head 102, the control portion 90 controls the shuttle driving member 50 so that the cleaning shuttle 40 moves from the home position to a position below the at least one printing head 102 (operation S10).

When the cleaning shuttle 40 moves to the position below the at least one printing head 102, the sprayer 21 of the cleaning shuttle 40 operates to spray a quantity of cleaning solution toward the at least one printing head 102 (operation S20). At this time, when the cleaning shuttle 40 moves at high speed, that is, at or above reference speed, the sprayer 21 can spray a quantity of cleaning solution. However, when the cleaning shuttle 40 moves at low speed, that is, below reference speed, the sprayer 21 does not spray a quantity of cleaning solution.

After the cleaning shuttle 40 finishes spraying the cleaning solution with respect to the at least one printing head 102, the control portion 90 causes the cleaning shuttle 40 to return to the home position (operation S30). At this time, the cleaning shuttle 40 moves at low speed so that the cleaning solution is not sprayed.

After the cleaning shuttle 40 returns to the home position, the main control portion controls the wiping unit 110 to wipe the nozzle surface 104 of the printing head 102 (operation S40).

Figure 10:
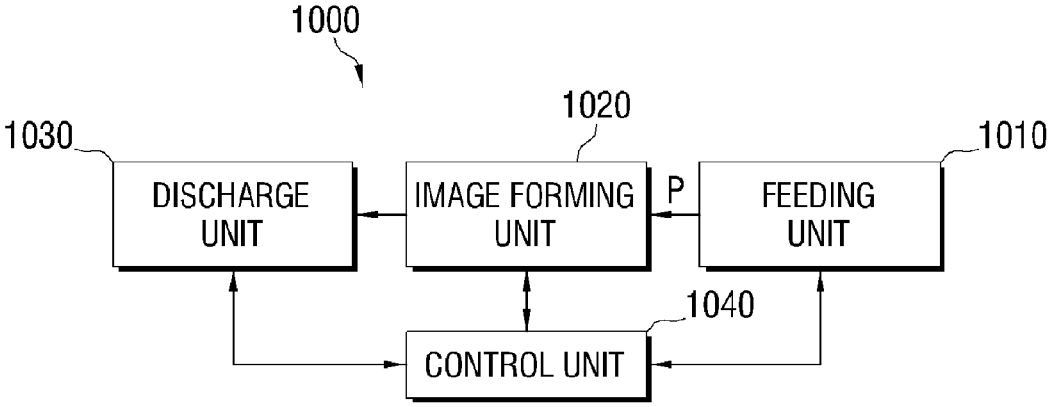
FIG. 10 is a diagram to illustrate an image forming apparatus of the present general inventive concept.

FIG. 10 is a diagram illustrating an image forming apparatus 1000 according to an embodiment of the present general inventive concept. The image forming apparatus 1000 may include a feeding unit 1010, an image forming unit 1020, a discharging unit 1030, and a control unit 1040. The image forming unit 1020 may include a cartridge including a combination of elements, as described with regard to FIGS. 1-8, to eject ink onto a printing medium using the print head and a cleaning apparatus to clean the print head. For example, the image forming unit 1020 may include the printing head cleaning apparatus 10.

A printing medium is fed from the feeding unit 1010 to the image forming unit 1020 along path P of the printing medium. An image is formed on the printing medium by the image forming unit 1020, and the printing medium is discharged by the discharging unit 1030. After the image has been formed, the printing head cleaning apparatus 10 may clean the printing heads as described with regard to FIG. 9.

With the printing head cleaning apparatus according to an embodiment of the present general inventive concept, the image forming apparatus having the same, and the method to clean the printing head, a sprayer is used to spray a quantity of cleaning solution. Therefore, manufacturing cost thereof may be decreased compared with a printing head cleaning apparatus using ultrasonic waves.

Also, in the printing head cleaning apparatus according to an embodiment of the present general inventive concept, a moving cleaning shuttle is not provided with a driving source, like a motor, and a printed circuit board so that an electric wire is not required to supply electric power to the cleaning shuttle. Therefore, the structure thereof is simple so there is little possibility of a malfunction occurring.

With the printing head cleaning apparatus according to an embodiment of the present general inventive concept, the image forming apparatus having the same, and the method to clean the printing head, a sprayer sprays a quantity of cleaning solution toward a printing head so that ink solidified on a nozzle surface of the printing head can easily be removed.

Furthermore, with the printing head cleaning apparatus according to an embodiment of the present general inventive concept, the image forming apparatus having the same, and the method to clean the printing head, a sprayer is used to spray a quantity of cleaning solution so that the structure of the printing head cleaning apparatus is simple and manufacturing cost thereof may be reduced.

Furthermore, with the printing head cleaning apparatus according to an embodiment of the present general inventive concept, the image forming apparatus having the same, and the method to clean the printing head, movement of a cleaning shuttle causes a sprayer to operate so that the cleaning shuttle is not required to have a separate driving source or a printed circuit board to drive the sprayer. Therefore, the structure thereof is simple so that maintenance thereof is easy and durability thereof is good.

Although a few embodiments of the present general inventive concept have been shown and described, it will be appreciated those skilled in the art that changes may be made in these embodiments without departing from the principles and spirit of the general inventive concept, the scope of which is defined in the attached claims and their equivalents.

What is claimed is:

1. A printing head cleaning apparatus usable with an image forming apparatus, comprising:

a spraying unit to spray a quantity of cleaning solution using a sprayer; and a cleaning shuttle to carry the spraying unit, wherein the spraying unit comprises:

a cleaning solution tank to store the cleaning solution sprayed by the sprayer, a spraying cam to operate the sprayer to selectively spray a quantity of the cleaning solution, and a cam driving member to cause the spraying cam to rotate according to movement of the cleaning shuttle.

2. The printing head cleaning apparatus of claim 1, wherein the spraying unit further comprises;

a spraying direction changing member to change a spraying direction of the sprayer.

3. The printing head cleaning apparatus of claim 1, wherein the cam driving member comprises;

a rack gear disposed parallel to a moving direction of the cleaning shuttle;

a driven gear to engage with the rack gear, the driven gear rotatably disposed at the cleaning shuttle; and a cam gear train to transmit rotation of the driven gear to the spraying cam;

wherein when the cleaning shuttle moves, the driven gear and the cam gear train cause the spraying cam to rotate.

4. The printing head cleaning apparatus of claim 1, wherein when the spraying cam rotates at or above reference speed, the sprayer sprays the cleaning solution, and when the spraying cam rotates below the reference speed, the sprayer does not spray the cleaning solution.

5. The printing head cleaning apparatus of claim 1, further comprising:

a shuttle driving member to cause the cleaning shuttle to move.

6. The printing head cleaning apparatus of claim 5, wherein the shuttle driving member comprises;

a belt to which the cleaning shuttle is fixed;

a plurality of driving and driven pulleys to support the belt to move along a caterpillar track; and a driving motor to rotate the driving pulley.

7. The printing head cleaning apparatus of claim 6, wherein the shuttle driving member further comprises a guide rail to guide the movement of the cleaning shuttle.

8. An image forming apparatus, comprising:

an ink cartridge having at least one printing head to fire ink onto a printing medium;

a spraying unit spaced apart from the at least one printing head of the ink cartridge, the spraying unit formed to spray a quantity of cleaning solution toward the at least one printing head using a sprayer;

a cleaning shuttle in which the spraying unit is disposed;

a shuttle driving member to cause the cleaning shuttle to move in a direction transverse to a transferring direction of the printing medium; and a control portion to control the shuttle driving member so that the spraying unit sprays a quantity of cleaning solution, wherein the shuttle driving member comprises:

a belt to which the cleaning shuttle is fixed, a plurality of driving and driven pulleys to support the belt to move along a caterpillar track, and a driving motor to rotate the driving pulley.

9. The image forming apparatus of claim 8, wherein the shuttle driving member further comprises a guide rail disposed parallel to the belt to guide movement of the cleaning shuttle.

10. The image forming apparatus of claim 9, wherein the spraying unit comprises;

a cleaning solution tank to store the cleaning solution sprayed by the sprayer;

a spraying cam to operate the sprayer to selectively spray the cleaning solution; and a cam driving member to cause the spraying cam to rotate according to the movement of the cleaning shuttle.

11. The image forming apparatus of claim 10, wherein the cam driving member comprises;

a rack gear disposed on a top surface of the guide rail;

a driven gear to engage with the rack gear, the driven gear rotatably disposed at the cleaning shuttle; and a cam gear train to transmit rotation of the driven gear to the spraying cam;

wherein when the shuttle driving member causes the cleaning shuttle to move, the rack gear causes the driven gear to rotate so that the spraying cam rotates.

12. The image forming apparatus of claim 8, wherein the control portion controls the shuttle driving member so that the spraying unit sprays the cleaning solution directly to the at least one printing head.

13. The image forming apparatus of claim 8, wherein the control portion controls the shuttle driving member so that the spraying unit sprays the cleaning solution to an area between each of the at least one printing head.

14. The image forming apparatus of claim 8, wherein the control portion controls moving speed of the cleaning shuttle so that the sprayer selectively sprays a quantity of cleaning solution.

15. An image forming apparatus, comprising;

an ink cartridge having at least one printing head to fire ink onto a printing medium;

a spraying unit spaced apart from the at least one printing head of the ink cartridge, the spraying unit formed to spray a quantity of cleaning solution toward the at least one printing head using a sprayer;

a cleaning shuttle in which the spraying unit is disposed;

a shuttle driving member to cause the cleaning shuttle to move in a direction transverse to a transferring direction of the printing medium; and a control portion to control the shuttle driving member so that the spraying unit sprays a quantity of cleaning solution, wherein the control portion controls the spraying unit so that when the cleaning shuttle moves in a first direction, the spraying unit sprays a quantity of cleaning solution, and when the cleaning shuttle moves in a second direction, the spraying unit does not spray a quantity of cleaning solution.

16. An image forming apparatus, comprising:

an ink cartridge having a plurality of printing heads to fire ink onto a printing medium, the plurality of printing heads arranged in a plurality of rows in a transferring direction of the printing medium;

a spraying unit spaced apart from the plurality of printing heads of the ink cartridge, the spraying unit formed to spray a quantity of cleaning solution to the plurality of printing heads using at least one sprayer;

a cleaning shuttle in which the spraying unit is disposed;

a shuttle driving member to cause the cleaning shuttle to move in a direction transverse to the transferring direction of the printing medium; and a control portion to control the shuttle driving member so that the spraying unit sprays a quantity of cleaning solution, wherein the at least one sprayer is formed to change a direction so as to spray the cleaning solution corresponding to each of rows of the plurality of printing heads.

17. The image forming apparatus of claim 16, wherein a number of the at least one sprayer is the same as the number of rows of the plurality of printing heads, and the at least one sprayer is disposed to corresponding to each of the rows of the plurality of printing heads.

18. The image forming apparatus of claim 16, wherein a number of the at least one sprayer is smaller than the number of rows of the plurality of printing heads, and at least one of the number of the at least one sprayer is disposed corresponding to at least one area between the rows of the plurality of printing heads.

19. An image forming apparatus, comprising:

an ink cartridge with at least one print head; and a spray unit disposed to move with respect to the at least one print head and to spray a cleaning solution toward the at least one print head while moving with respect to the at least one print head, wherein the spray unit comprises:

a sprayer to spray the cleaning solution, a cleaning solution tank to store the cleaning solution, a spraying cam to operate the sprayer to selectively spray a quantity of the cleaning solution, and a cam driving member to cause the spraying cam to rotate according to movement of a cleaning shuttle.

* * * * *

UNITED STATES PATENT AND TRADEMARK OFFICE

CERTIFICATE OF CORRECTION

PATENT NO. : 8,070,254 B2
APPLICATION NO. : 12/394334
DATED : December 6, 2011
INVENTOR(S) : Jung-dae Heo et al.

It is certified that error appears in the above-identified patent and that said Letters Patent is hereby corrected as shown below:

Title page, item (30) Foreign Application Priority Data should read as follows:
June 4, 2008 (KR).....10-2008-0052742

Signed and Sealed this
Twenty-ninth Day of May, 2012

David J. Kappos

David J. Kappos
*Director of the United States Patent and Trademark Office*